US011306565B2

(12) United States Patent
Newell

(10) Patent No.: US 11,306,565 B2
(45) Date of Patent: Apr. 19, 2022

(54) FIRING STAND FOR SHAPED CHARGES

(71) Applicant: THE SECRETARY OF STATE FOR DEFENCE, Salisbury (GB)

(72) Inventor: David Timothy Newell, Salisbury (GB)

(73) Assignee: The Secretaiy of State for Defence, Salisbury (GB)

( * ) Notice: Subject to any disclaimer, the term of this patent is extended or adjusted under 35 U.S.C. 154(b) by 0 days.

(21) Appl. No.: 16/969,796

(22) PCT Filed: Feb. 22, 2019

(86) PCT No.: PCT/GB2019/000032

§ 371 (c)(1),
(2) Date: Aug. 13, 2020

(87) PCT Pub. No.: WO2019/166753

PCT Pub. Date: Sep. 6, 2019

(65) Prior Publication Data

US 2020/0399994 A1 Dec. 24, 2020

(30) Foreign Application Priority Data

Feb. 27, 2018 (GB) ..... 1803144

(51) Int. Cl.
*E21B 43/117* (2006.01)
*F42B 1/028* (2006.01)
(Continued)

(52) U.S. Cl.
CPC ..... *E21B 43/117* (2013.01); *F42B 1/028* (2013.01); *E21B 43/119* (2013.01); *F42B 1/032* (2013.01); *F42D 3/00* (2013.01); *F42D 5/04* (2013.01)

(58) Field of Classification Search
CPC ..... F42D 1/02; F42D 3/00
See application file for complete search history.

(56) References Cited

U.S. PATENT DOCUMENTS 4,856,430 A * 8/1989 Gibb ..... F42B 3/08 102/307
4,942,991 A * 7/1990 Lyons ..... F42B 39/02 206/3

(Continued)

FOREIGN PATENT DOCUMENTS

| | | | |
|---|---|---|---|
| CA | 2314808 | A1 | 5/2001 |
| GB | 2485057 | A | 5/2012 |
| WO | 2017199044 | A1 | 11/2017 |

OTHER PUBLICATIONS

United Kingdom Patent Application No. GB1902491.8, Intention to Grant dated Feb. 19, 2020, 2 pages.

(Continued)

*Primary Examiner* — Joshua T Semick
(74) *Attorney, Agent, or Firm* — Kilpatrick Townsend & Stockton LLP

(57) ABSTRACT

A firing stand (30) for mounting a plurality of shaped charges. The firing stand (30) can be configured by a user between a transport configuration in which shaped charges are stored for transport, and at least a first firing configuration from which shaped charges can be deployed. Interconnected rotating panels (31) may be used to provide user configurability to the firing stand (30), with shaped charges optionally being mounted in panel apertures (36). The firing stand provides for rapid and configurable deployment of multiple shaped charges.

19 Claims, 4 Drawing Sheets

(51) Int. Cl.

| | |
|---|---|
| ***E21B 43/119*** | (2006.01) |
| ***F42B 1/032*** | (2006.01) |
| ***F42D 3/00*** | (2006.01) |
| ***F42D 5/04*** | (2006.01) |

(56) References Cited

U.S. PATENT DOCUMENTS

| | | | | |
|---|---|---|---|---|
| 7,337,703 | B2 * | 3/2008 | Sansolo | F42D 3/00 102/307 |
| 8,365,666 | B1 * | 2/2013 | Hooke | F42D 1/04 102/306 |
| 9,829,296 | B1 * | 11/2017 | Askin | F42D 5/04 |
| 10,495,431 | B2 * | 12/2019 | Barzilai | F42B 3/02 |
| 10,527,396 | B2 * | 1/2020 | Raymond | F42D 5/04 |
| 2005/0126420 | A1 * | 6/2005 | Givens | F42B 3/02 102/310 |
| 2014/0076133 | A1 | 3/2014 | Brill et al. | |
| 2017/0184379 | A1 | 6/2017 | Barzilai | |
| 2019/0093820 | A1 * | 3/2019 | Lumley | F16M 13/02 |

OTHER PUBLICATIONS

United Kingdom Patent Application No. GB1902491.8, Decision to Grant dated Apr. 7, 2020, 2 pages.

International Patent Application No. PCT/GB2019/000032, International Preliminary Report on Patentability dated Sep. 3, 2020, 9 pages.

United Kingdom Patent Application No. GB1803144.3, Search Report dated Apr. 30, 2018, 4 pages.

International Patent Application No. PCT/GB2019/000032, International Search Report and Written Opinion dated May 10, 2019, 15 pages.

United Kingdom Patent Application No. GB1902491.8, Combined Search and Examination Report dated Jul. 29, 2019, 5 pages.

* cited by examiner

FIRING STAND FOR SHAPED CHARGES

TECHNICAL FIELD OF THE INVENTION

This invention relates to the field of firing stands, in particular to firing stands suitable for mounting shaped charges.

BACKGROUND TO THE INVENTION

Shaped charges are used in a variety of applications to penetrate into, breach, or cut, a target object or material. Exemplar applications include oil well perforation, the breaching of barriers such as doors, windows or walls, and military applications such as armour penetration or the disruption of improvised explosive devices. A shaped charge comprises an outer casing having an internal cavity filled with explosive material, the explosive material having a void or hollow cut into one end that is then lined with a metallic shaped charge liner. Upon detonation of the explosive, the presence of the void or hollow results in a focussing effect of the detonation onto the shaped charge liner. The liner resultantly collapsing to form a jet of fast moving metallic material propagating axially away from the shaped charge. It is this metallic jet that delivers the desired penetrative effect of the shaped charge.

A shaped charge may be launched from a firing stand. For example in oil well perforation the firing stands used are referred to as perforation guns. Perforation guns are used to puncture the casing or liner of an oil well to connect it to an oil reservoir. A perforation gun essentially comprises a plurality of explosive charges (shaped charges) on a strip of mounting material. The strip of mounting material being lowered into the oil well and the explosive charges detonated to perforate the oil well liner casing. In barrier breaching, shaped charges or linear shaped charges are used to blast through a barrier such as a locked door, with a view to gaining entry. The shaped charges or linear shaped charges are arranged inside a framework attached to the barrier to be breached, forming the mounting system. Firing stands are also used in building demolition, to cut through, for instance, columns or beams of a building. In all of these applications owing to the shaped charges comprising explosive material, they must be transported to a deployment location in appropriate packaging, for instance in ammunition packaging. The user of the shaped charge therefore subjected to a time burden in removing the charge from the packaging at the deployment location, and subsequently assembling the shaped charge onto a suitable firing stand.

Known approaches to disrupting improvised explosive devices are to use either a shaped charge or a water jet, fired at the explosive device, to blast apart the device before a detonation signal within the device becomes effective. The shaped charge or water jet disruptor is not manually held and fired, instead being mounted to a firing stand. The user of the disruptor system is then able to trigger the disruptor from a safe stand-off distance. Particularly in this application, a user may be forced to manually transport the disruptor system to the location of use, and may have significant time constraints on assembling and disrupting the explosive device presented before him. There may be pressure on the user to achieve success in using the disruptor on his first attempt. Therefore the user must be extremely precise in the deployment and firing of the shaped charge, all under a significant time pressure.

Therefore it is an aim of the present invention to provide an alternative firing stand suitable for mounting shaped charges that mitigates these issues.

SUMMARY OF THE INVENTION

According to a first aspect of the invention there is provided a firing stand for mounting a plurality of shaped charges, wherein the firing stand is user configurable between a transport configuration and at least a first firing configuration.

A firing stand is an item of equipment or apparatus that is suitable for holding and firing therefrom, shaped charges. The firing stand provides the physical framework to which the shaped charges are attachable, such that they may be aimed towards a target, and then fired. The shaped charges may be attached by interference fit with apertures in the firing stand, by clips, by clamping or by other means. These attachment means may be non-permanent in nature, such that the shaped charges can be removed if necessary and the firing stand reused, for instance after the shaped charges have been fired. The firing stand may also provide means for interfacing with other items of equipment other than the shaped charges. For instance it may be necessary to couple an initiation system to the shaped charges, and the firing stand may provide supporting means such as clips, cable runs, or apertures, for these additional items or components.

The term 'mounting a plurality of shaped charges' is intended to mean that the firing stand has the functionally to hold greater than one shaped charge in a particular orientation, such as directed towards an intended target. Prior art shaped charge disruptor systems typically have the capability to fire a single shaped charge. This places significant burden on the precise deployment of the firing stand of the disruptor system, such that the shaped charge is orientated towards the optimum location on the target explosive device to deliver maximal disruptive effect. Such precision can be practically difficult to achieve, particularly wherein the internal contents of the explosive device are unknown. The inventor has shown that simultaneous delivery of multiple shaped charges onto a target explosive device mitigates the precision required when using a single shaped charge, by delivering a 'shock' effect to the entirety of, or a substantial portion of, the explosive device. Therefore the inventor has developed a firing stand in accordance with the invention that provides the functionality to mount a plurality of shaped charges. Such functionality may also be advantageous in applications such as building demolition, where for instance a firing stand that can be arranged to encircle a column of a building, thereby aiming a plurality of shaped charges inwards towards the column, is particularly useful.

The term 'user configurable' is intended to mean that a user of the firing stand can manipulate the firing stand to a particular physical arrangement suited to the application for which the firing stand is being used. The firing stand may comprise elements that can be slotted together in a particular arrangement, or may comprise elements that can be rotated relative to each other, or that fold against each other. The firing stand of the invention is intended to be configurable into at least a first firing configuration. A firing configuration is a physical arrangement of the components of the firing stand that is used when shaped charges are being fired from the stand. The firing configuration may vary dependent on application. For instance the firing stand may comprise three panels that can be connected to each other with relative orientations. In oil well perforation it may be necessary to arrange these elements such that they are planar, in order for them to be lowered down a narrow oil well. In door breaching it may be desirable to arrange these elements in an 'L' shape around the locking mechanism of a door. In the disruption of explosive devices it may be necessary to arrange these elements substantially in a 'C' arrangement around an explosive device, to ensure shaped charges mounted to the firing stand are all directed inwards towards the explosive device. The ability to configure the physical arrangement of the firing stand significantly increases the breadth of applications for which the firing stand can be used.

The inventor has identified that the deployment time of firing stands with a shaped charge can be significantly reduced if the firing stand itself forms part of the shaped charge transport solution. Shaped charges must be transported by appropriate means owing to their explosive nature. This may mean packaging the shaped charges into an ammunition container. The present invention is user-configurable into a transport configuration. The transport configuration is a physical arrangement of the firing stand that enables the firing stand to be readily transported, for instance within an ammunition container. In a particular embodiment the firing stand may fold upon itself so as to fit within an ammunition case such as the A480 case. It is the intention that the transport configuration is also a physical arrangement of the firing stand that provides for the secure holding of shaped charges during transport. Thus upon arrival at a deployment location, the user of the firing stand may remove the stand from an ammunition case, and deploy the firing stand already pre-mounted with a plurality of shaped charges.

In some embodiments of the invention the firing stand comprises a plurality of mounting panels. The mounting panels are substantially planar objects of finite thickness. In these embodiments the mounting panels provide the surface to which the shaped charges are attached and held, both in the firing configuration and the transport configuration. The mounting panels may be completely separable from each other, such that they can be used in an inter-connected fashion, or individually. For instance the mounting panels may comprise connecting apertures and protrusions, the protrusions of one mounting panel being tightly receivable into the connecting aperture of another mounting panel. The mounting panels thereby being connectable via these means into a firing configuration or transport configuration. Alternatively, and preferably each mounting panel comprises a hinging means for attaching a first mounting panel in the plurality of mounting panels to a second mounting panel in the plurality of mounting panels. The hinging means allows two mounting panels to rotate relative to each other about some axis. The hinging means may operate in a similar manner to a door being hingedly connected to a door frame. However even more preferred embodiments provide a hinging means in the form of a rod and eyelet interface. In these embodiments each mounting panel comprises a rod extending through the mounting panel in a coplanar direction, substantially at an edge, and parallel to that edge, of the panel. This same edge of the panel also comprises a series of cut-outs into which spacers reside, the rod also passing through said spacers via an eyelet. Each spacer is connected to two mounting panels in this way, such that the two panels are attached to each other, but can rotate about the axis of their respective rods, and therefore relative to each other. In some embodiments of the invention it may be possible to remove said rods so as separate two mounting panels, but also add said rods so as to connect two or more mounting panels together as a single firing stand. Each mounting panel may provide said rod and eyelet interface at one or more edges of the panel, such that the panels can be connected in a variety of individual orientations.

In some embodiments of the invention, the hinging means comprises clamping means for fixing the relative orientation of the mounting panels. The clamping means preferably being finger adjustable. Once the firing stand has been arranged in the transport configuration or a firing configuration, it is preferable to fix that position, such that the orientation of the mounting panels relative to each other, cannot be altered. This is particularly advantageous where the shaped charges are being aimed at a particular location or target, such as an explosive device, or point of structural weakness in building demolition. Finger adjustable screws may be used to exert pressure through a mounting panel or through a spacer, against a respective rod, thereby restricting rotation of the mounting panel or spacer about that rod. In some applications, the user of the firing stand is the only person in proximity to the firing stand, or indeed the user may not have access to other tools to enable this fixing of the mounting panel orientation. In these scenarios finger adjustable means such as finger adjustable screws are particularly advantageous.

The mounting panels provide the surface onto which, or into which, the shaped charges are mounted. In some preferred embodiments of the invention the mounting panels comprise a plurality of apertures for mounting the plurality of shaped charges. The plurality of apertures may extend entirely or partially through the mounting panels. The apertures extending entirely through the mounting panels may be preferable in embodiments where a detonator must interface directly with the shaped charge, but also apertures extending entirely through the panels would enable either side of the panel to be used for holding a shaped charge. The apertures may be arranged as a matrix i.e. in rows and columns. The shaped charges may be held within the apertures through an interference fit. It is envisaged that spacers may be used to enable a variety of shaped charges to fit within the apertures as a plug fit. The plurality of apertures enables one or more shaped charges to be used with the invention. The plurality of apertures also enables a user to determine an optimum position on the mounting panels for the shaped charges. For instance a user may wish to target a door above and below a lock. In this scenario a single mounting panel may be used and a shaped charge may be fitted into the mounting panel in an aperture near the top of the mounting panel, and a further shaped charge fitted into a mounting panel near the bottom, for instance.

In some embodiments of the invention the firing stand further comprises a stand base. The stand base is a platform intermediate to the mounting panels and the surface onto which the firing stand is intended to be placed. The stand base may be removably attachable to the mounting panels. The stand base provides greater stability to the mounting panels when the firing stand is in a firing configuration or on an otherwise unstable or non-planar surface. The stand base also improves stability during the launch/firing of the shaped charges. The firing stand is intended to be detachable from the mounting panels, such that its use is optional. A preferred embodiment of the firing stand therefore comprises panel slots for holding the mounting panels. The panel slots defining non-movable jaws that provide an interference fit around part of a mounting panel (for instance a lower edge of the panel). The stand base may be one complete part, the panel slots being cut-outs of the stand base itself. Alternatively in some embodiments of the invention each panel slot may be a separate part of the stand base that is rotatable about an axis perpendicular to the plane of the panel slot. This rotation may be realised by a rotatable connection with another part of the stand base. This enables a mounting panel residing within a panel slot to also be rotated, thereby adjusting the elevation orientation of a shaped charge attached to the mounting panel. In these embodiments an elevation locking means to lock the rotation of the panel slots relative to the rest of the stand base may also be required.

The firing stand provides the benefit of dual use as both a stand for firing shaped charges, but also as part of the transport solution for the shaped charges. In preferred embodiments of the invention the firing stand is substantially formed from an ammunition packaging material. The term 'substantially formed' is used to acknowledge that minor elements of the firing stand, such as the rods used for connecting the mounting panels in some embodiments of the invention, may not be formed from ammunition packaging material. By forming the firing stand from ammunition packaging material, the firing stand in the transport configuration provides the necessary packaging material for transporting shaped charges themselves. This means the firing stand with shaped charges mounted therein, can be placed inside an ammunition container and transported without requiring a significant amount of additional ammunition packaging material. Indeed forming a firing stand from ammunition packaging material may be beneficial even for firing stands for single shaped charges. Furthermore, at a deployment location, the shaped charges can be removed from the ammunition container already in their firing stand. Further preferred embodiments of the invention use low density plastazoate foam as the packaging material. Using low density foam of this type reduces the hazard posed by fragmentation of the firing stand during use of the shaped charges. Furthermore, low density plastazoate foam is a relatively lightweight ammunition packaging material to transport to and from a deployment location.

According to a second aspect of the invention there is provided a shaped charge disruptor system comprising the firing stand of the first aspect of the invention and a plurality of shaped charges mounted with the firing stand. A disruptor system is apparatus for exerting a 'shock' effect to an explosive device in order to break apart the components of the explosive device, before a detonation signal can have effect. Prior art disruptor systems include water jet disruptors and shaped charge disruptors. The firing stands available for prior art shaped charge disruptors provide a capability to fire a single shaped charge precisely at an explosive device, with the intention of the explosive device being penetrated by the shaped charge, such that components of the explosive device along the path of penetration can be damaged beyond use. However such an approach places significant burden on deploying the prior art firing stand accurately and precisely, and is not well suited to scenarios where precise position of components within an explosive device are unknown.

The inventor has shown that a disruptive effect on an explosive device can also be achieved by firing multiple shaped charges, simultaneously, at an explosive device. The disruptor system of the second aspect of the invention therefore provides a plurality of shaped charges mounted with (attached to) a firing stand. The second aspect of the invention delivers an overall 'shock' to an explosive device by impacting the device at a number of locations simultaneously with shaped charges. The overall disruptive effect therefore not being limited to a particular penetration route of a single shaped charge, but rather that of multiple shaped charges.

In preferred embodiments of the second aspect of the invention a precision initiation system is used. The precision initiation system may provide simultaneous detonation signals to the plurality of shaped charges, thereby achieving simultaneous impact of a plurality of shaped charges onto an explosive device. The precision initiation system may comprise a precision initiator for each of the plurality of shaped charges. A precision initiator receives a detonation signal (typically as an explosive shockwave) and transfers that signal, on-axis, to a shaped charge. The precision initiator itself may comprise explosive material arranged inside a structure that delivers the on-axis shaped charge detonation. For instance the explosive material may reside within a cavity of the structure having a first wide portion, a narrow portion and a second wide portion, all concentric to each other. The wide portion receives the initial detonation signal and then channels that signal into the narrow portion, before channelling the now on-axis signal into the second wide portion and thereafter to the shaped charge itself. The propagation of the detonation of the explosive material within a shaped charge is considerably affected by the precision of the initiation of shaped charge. In particular, shaped charges within conically shaped liners require precise point detonation to ensure uniform collapse of the liner into a jet of material. A precision initiator may therefore be used to mitigate any misalignment of a detonator with a respective shaped charge.

According to a third aspect of the invention there is provided a method of disrupting an explosive device, the method comprising the steps of: Providing the shaped charge disruptor system of the second aspect of the invention; arranging the firing stand in the firing configuration such that the plurality of shaped charges are orientated towards the explosive device; and simultaneously initiating the plurality of shaped charges.

The firing stand is arranged into a firing configuration, the firing stand already having the shaped charges mounted with the stand. The firing configuration may be different for different explosive devices, or explosive device locations. The firing configuration being an arrangement of the components of the firing stand from which shaped charges can be fired i.e. an arrangement that achieves an orientation or 'aims' the shaped charges towards desired target locations on the explosive device. The term 'simultaneously initiating' is intended to mean that the plurality of shaped charges are detonated simultaneously, although it is accepted that minor time differences in the detonation of the shaped charges may arise during use.

BRIEF DESCRIPTION OF THE DRAWINGS

Embodiments of the invention will now be described by way of example only and with reference to the accompanying drawings, in which.

DETAILED DESCRIPTION

Figure 1:
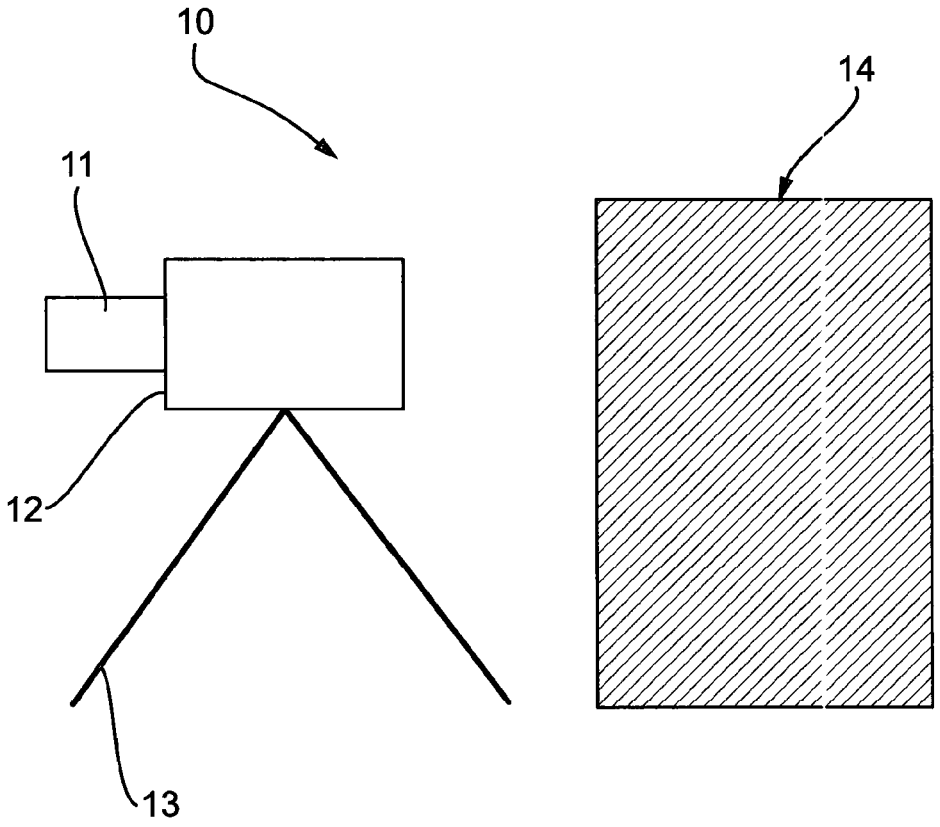
Fig. 1 Prior art
FIG. 1 provides an illustration of a prior art disruptor system.

FIG. 1 shows an illustration of a prior art disruptor system 10 being aimed towards an improvised explosive device 14.

The prior art disruptor system comprises a single shaped charge 12, detonator 11 and a firing stand 13. The firing stand 13 is for illustrative purposes only and practically may comprise more legs supporting shaped charge 12. The shaped charge 12 is orientated towards explosive device 14 such that when detonator 11 detonates shaped charge 12, the shaped charge jet (not shown) propagates towards explosive device 14. The shaped charge jet subsequently penetrates explosive device 14 and damages internal components so as to prevent detonation of device 14. This illustration shows the capability of the prior art to only fire a single shaped charge 12. The single shaped charge 12 delivering a disruptive effect to explosive device 14 along the direction of penetration of the respective shaped charge jet. For explosive devices 14 wherein the internal contents, or the internal arrangement of the contents, are unknown, this prior art can result in the disruptive effect being delivered inappropriately, or ineffectively, to the explosive device 14. Furthermore a user of disruptor 10 is required to mount shaped charge 12 to firing stand 13 prior to use, using up valuable time.

Figure 2:
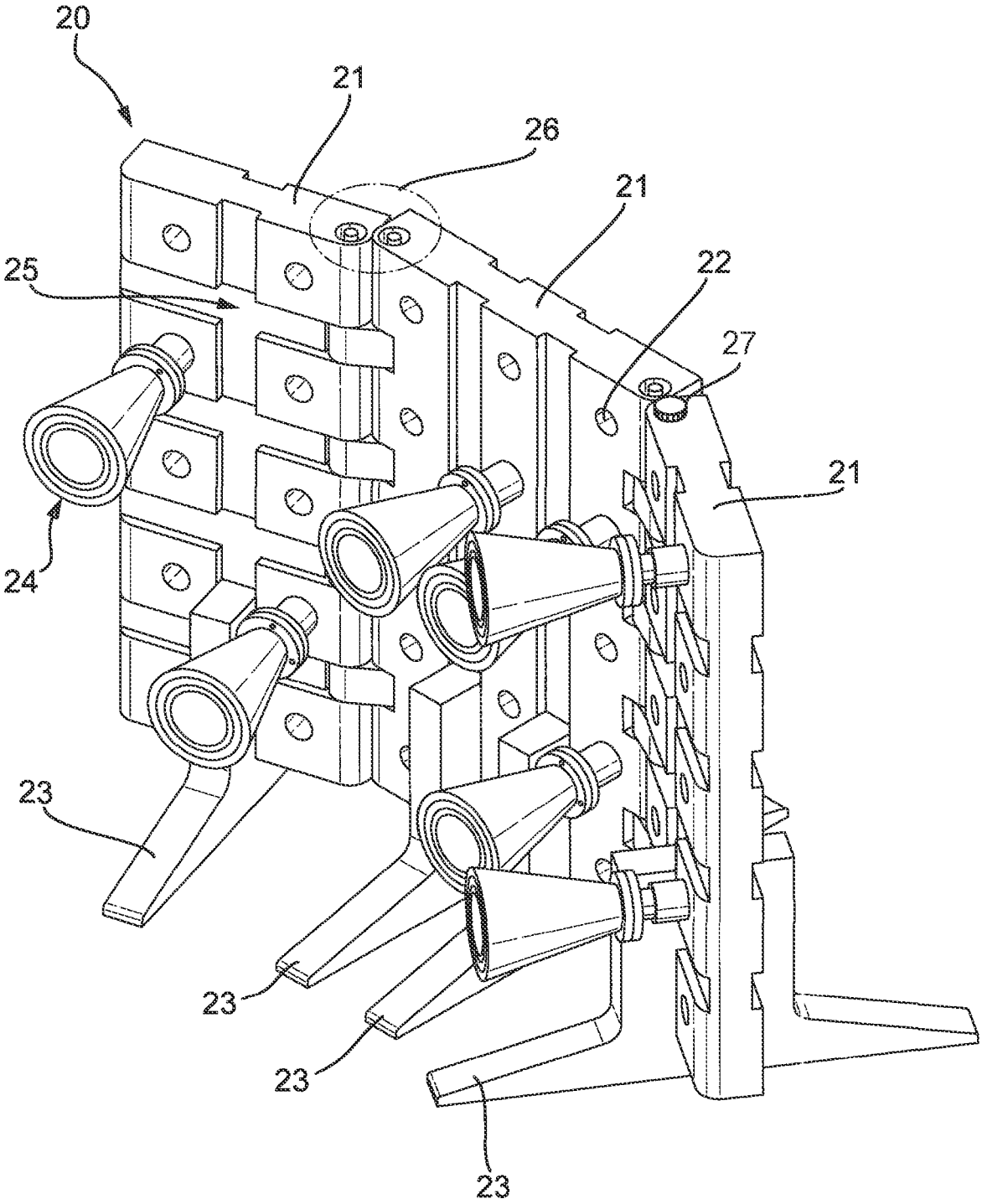
FIG. 2 provides an illustration of an embodiment of the disruptor system of the invention.

FIG. 2 shows an illustration of an embodiment of the disruptor system of the invention 20 comprising three mounting panels 21, a stand base 23 and a plurality of shaped charges 24 comprising shaped charge liners. The mounting panels 21 are substantially planar and comprise a matrix arrangement of apertures 22 into which shaped charges 24 can be held. The shaped charges 24 are held within apertures 22 owing to an interference fit, although other mechanisms may be used in other embodiments. The mounting panels 21 and stand base 23 are in a firing configuration. The mounting panels 21 are illustrated in this embodiment as having different arrangements of apertures 22, but identical matrix arrangements could equally be used. The mounting panels 21 show a grid structure of reduced thickness 25 around which the panel slots of stand base 23 are able to conform, enabling the mounting panels 21 to be attached to stand base 23 in a variety of orientations. The mounting panels 21 are attached to each other using a rod and eyelet interface 26. A lightweight plastazoate foam material is used to form the mounting panels 21 to reduce the fragmentation hazard posed by the firing stand.

Advantageously this foam material is an ammunition packaging material, and thus when the firing stand (comprising panels 21 and stand base 23) is folded (about the interfaces 26), the firing stand becomes the packaging for the shaped charges 24 in transport. The embodiment 20 has been designed such that in the transport configuration, it will fit within an A480 ammunition case. Other embodiments may fit within other cases such as an H83 ammunition case. In an example, the rod and eyelet interface 26 includes a clamping interface 27 that fixes a relative orientation of the panels 21. In some examples, the clamping interface 27 is finger adjustable.

Figure 3:
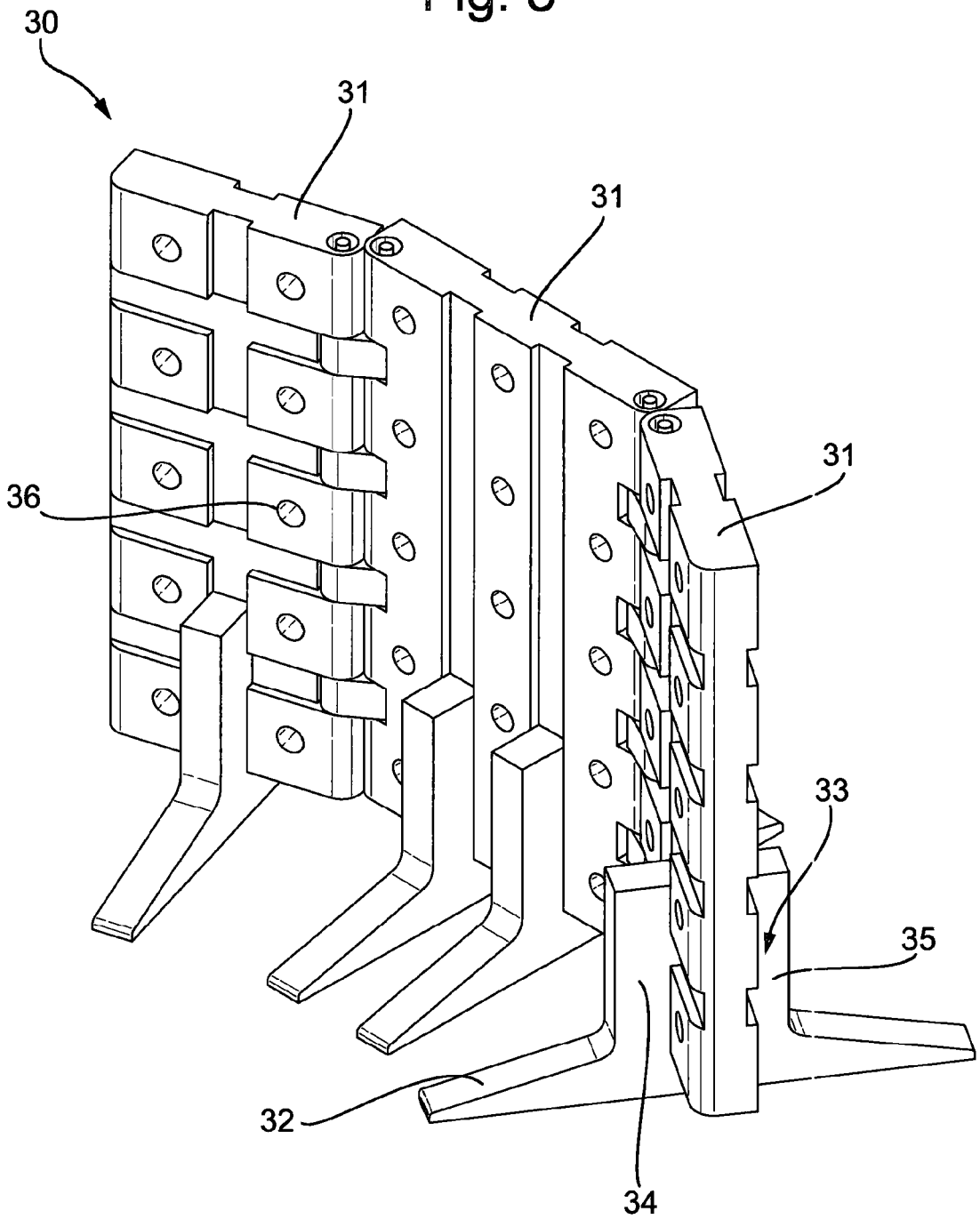
FIG. 3 provides an illustration of the firing stand in an embodiment of the invention.

FIG. 3 shows an illustration of the firing stand in an embodiment of the invention 30. The figure shows mounting panel 31, stand base 32 and the panel slot interface 33 between the stand base 32 and panel 31. The panel slot 33 comprises a first protrusion 34 and a second protrusion 35 defining between them a slot into which a region of reduced thickness on mounting panel 31 resides. The panel slot 33 provides an interference fit to the mounting panel 31. The panels 31 comprise apertures 36 for receiving shaped charges.

Figure 4:
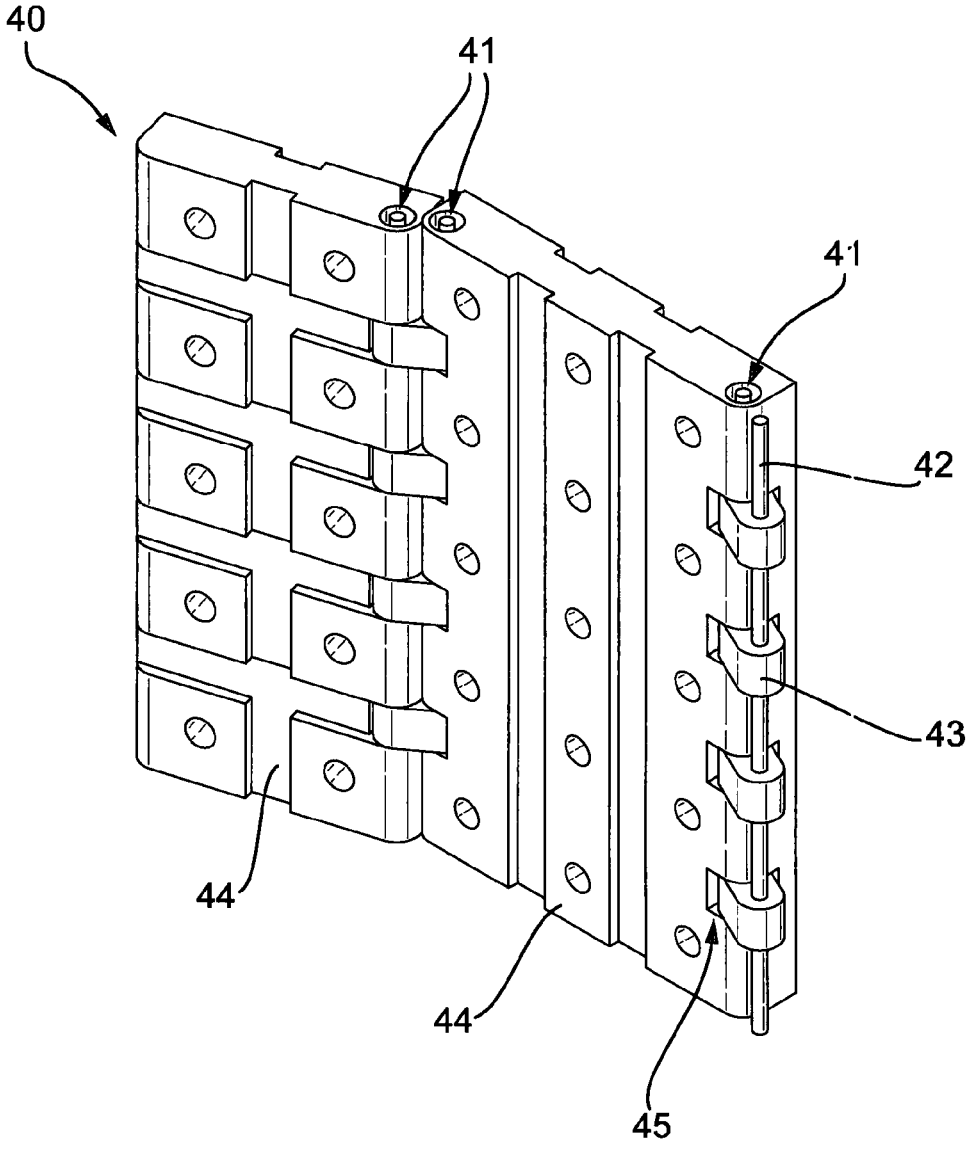
FIG. 4 provides an illustration of a rod and eyelet interface in an embodiment of the invention.

FIG. 4 shows an illustration of a rod and eyelet interface in an embodiment of the invention 40. The rods 41 are shown as being coplanar with their respective mounting panels 44, and running internally thereto along an edge of their respective panels 44. There is no additional mounting panel attached to rod 42 for illustrative purposes. Each mounting panel 44 has cutaways 45 into which spacers 43 are positioned. Rods 41 and 42 also extend through spacers 43 via eyelets. Each spacer 43 is intended to have two rods (one from each of the panels 44 being connected) running through it. The spacers 43 can rotate about rods 41/42. The panels 44 therefore can therefore be orientated relative to each other. The spacers 43 are formed from a foam material, as per the mounting panels 44. The rods 41/42 are formed from a plastic material.

The embodiments of FIGS. 2 to 4 are shown with apertures sized for receiving shaped charges and retaining them through an interference fit. However the shaped charges themselves may comprise features to further enable attachment to the firing stand. For instance a bayonet or screw threaded end may be present on a shaped charge that can be pushed through a hole in the firing stand and onto which a matching nut can be screwed. The nut preventing the shaped charge being pulled from the aperture within which it is located. Or alternatively, once a shaped charge is mounted in an aperture of the firing stand, a disc element attached to the shaped charge may be rotated outward from an end of the shaped charge, to engage a rear surface of the firing stand, and like the nut, prevent the shaped charge being pulled from its aperture. It would be clear to the skilled person that a number of alternative mechanisms for retaining the shaped charges within respective apertures of the firing stand are possible.

The invention claimed is:

1. A firing stand of a disruptor system, the firing stand comprising a plurality of apertures configured for mounting a plurality of shaped charges at discretely separate locations, wherein the firing stand is substantially formed from a foam-based ammunition packaging material, the firing stand being user configurable between a transport configuration in which the plurality of apertures hold the plurality of shaped charges during transport and at least a first firing configuration in which the plurality of apertures hold the plurality of shaped charges for orientation towards a target device to be disrupted by the disruptor system.

2. The firing stand of claim 1 wherein the firing stand comprises a plurality of mounting panels.

3. The firing stand of claim 2 wherein each mounting panel comprises a hinging means for attaching a first mounting panel in the plurality of mounting panels to a second mounting panel in the plurality of mounting panels.

4. The firing stand of claim 3 wherein the hinging means comprises a rod and eyelet interface.

5. The firing stand of claim 3 wherein the hinging means comprises a clamping means for fixing a relative orientation of the mounting panels.

6. The firing stand of claim 5 wherein the clamping means is finger adjustable.

7. The tiring stand of claim 2 wherein the mounting panels comprise the plurality of apertures for mounting the plurality of shaped charges.

8. The firing stand of claim 2 further comprising a stand base.

9. The firing stand of claim 8 wherein the stand base comprises panel slots for holding the mounting panels.

10. The firing stand of claim 1, wherein the firing stand is substantially formed from the foam-based ammunition packaging material.

11. The firing stand of claim 1 wherein the foam-based ammunition packaging material is a low density plastazoate foam.

12. The firing stand of claim 1, wherein the firing stand further comprises:

a first mounting panel comprising a first subset of the plurality of apertures;

a second mounting panel hingedly attached with the first mounting panel and comprising a second subset of the plurality of apertures; and a clamping means for fixing the first mounting panel and the second mounting panel in the first tiring position in a non-parallel relative arrangement in which the first subset of the plurality of apertures and the second subset of the plurality of apertures at least partially face toward one another such that the plurality of shaped charges are oriented towards the target device from different directions.

13. The firing stand of claim 2, wherein the plurality of mounting panels are configurable to be arranged in a substantially circular fashion, thereby directing the plurality of shaped charges inwards towards the target device.

14. The firing stand of claim 1, wherein the plurality of apertures hold the plurality of shaped charges for orientation substantially perpendicular to a surface of the foam-based ammunition packaging material.

15. The firing stand of claim 1, wherein each shaped charge comprises an outer casing having an internal cavity filled with explosive material and wherein the explosive material comprises a void that is cut into one end of the explosive material and a metallic shaped charge liner.

16. A shaped charge disruptor system comprising the tiring stand of claim 1 and a plurality of shaped charges.

17. The shaped charge disruptor system of claim 16 further comprising a precision initiation system.

18. A method of disrupting an explosive device, the method comprising the steps of:

a. providing the shaped charge disruptor system of claim 16;

b. arranging the firing stand in the first firing configuration such that the plurality of
shaped charges are orientated towards the explosive device; and c. simultaneously initiating the plurality of shaped charges.

19. The method of claim 18, wherein the plurality of apertures hold the plurality of shaped charges for orientation substantially perpendicular to a surface of the foam-based ammunition packaging material.

* * * * *